US008048272B2

(12) United States Patent
Mattsson et al.

(10) Patent No.: US 8,048,272 B2
(45) **Date of Patent: *Nov. 1, 2011**

(54) ARRANGEMENT FOR THE TREATMENT OF CELLULOSE PULP INVOLVING SEAL POSITIONING MEANS

(75) Inventors: Stefan Mattsson, Kvissleby (SE); Jörgen T. Lundberg, Sundsvall (SE); Rickard Andersson, Matfors (SE); Johan Bylander, Sundsvall (SE); Magnus Henriksson, Sundsvall (SE)

(73) Assignee: Metso Paper, Inc. (FI)

( * ) Notice: Subject to any disclaimer, the term of this patent is extended or adjusted under 35 U.S.C. 154(b) by 463 days.

This patent is subject to a terminal disclaimer.

(21) Appl. No.: 11/921,491

(22) PCT Filed: May 22, 2006

(86) PCT No.: PCT/SE2006/050147

§ 371 (c)(1),
(2), (4) Date: Feb. 17, 2009

(87) PCT Pub. No.: WO2006/130097

PCT Pub. Date: Dec. 7, 2006

(65) Prior Publication Data

US 2009/0218065 A1 Sep. 3, 2009

(30) Foreign Application Priority Data

Jun. 3, 2005 (SE) ..... 0501289

(51) Int. Cl.
*D21H 23/00* (2006.01)

(52) U.S. Cl. ..... 162/380

(58) Field of Classification Search ..... 162/380, 162/60, 272, 326, 232; 134/115 R; 210/326, 210/404, 402

See application file for complete search history.

(56) References Cited

U.S. PATENT DOCUMENTS

| | | | | |
|---|---|---|---|---|
| 2,741,369 | A | 4/1956 | Fest | |
| 6,086,713 | A * | 7/2000 | Qvintus et al. | 162/60 |
| 6,159,338 | A * | 12/2000 | Qvintus et al. | 162/56 |
| 6,461,473 | B1 * | 10/2002 | Qvintus et al. | 162/43 |

FOREIGN PATENT DOCUMENTS

DE 197 51 283 A1 5/1999

* cited by examiner

*Primary Examiner* — Mark Halpern

(74) *Attorney, Agent, or Firm* — Lerner, David, Littenberg, Krumholz & Mentlik, LLP

(57) ABSTRACT

A washer for washing and dewatering cellulose pulp is disclosed, comprising a rotary drum with a plurality of external compartments on the drum defined by axial compartment walls distributed along the circumference of the drum, a stationary cylindrical casing enclosing the drum, defining a ring-shaped space between the casing and the drum, and longitudinal seals in the axial direction of the drum diving the ring-shaped space into a forming zone for forming the pulp, at least one washing zone for washing the pulp at an overpressure, and a discharge zone, and where the longitudinal axial seals are attached to positioning cylinders for adjusting the radial position of the seals, and the longitudinal seal has an articulated connection with the positioning cylinders to make possible oblique positioning of the seal.

8 Claims, 2 Drawing Sheets

ARRANGEMENT FOR THE TREATMENT OF CELLULOSE PULP INVOLVING SEAL POSITIONING MEANS

This application is a 371 of PCT/SE06/050147 filed on 22 May 2006

FIELD OF THE INVENTION

The present invention relates to a washing arrangement of the type comprising a compartmented drum for washing and dewatering cellulose pulp.

BACKGROUND OF THE INVENTION

All fiber lines comprise some type of washing equipment to separate the digestion liquor from the pulp. Later on in the process a washing arrangement is provided to separate bleaching liquors, after the bleaching stages. There exist a number of different types of washing equipment which operate according to different principles.

One type of washing arrangement is the drum washer, where the pulp is dewatered on a rotary filter drum after the addition of washing liquid, which displaces the liquor remaining on the pulp web after preceding process stages, for example a digestion stage or a bleaching stage. The static overpressure causes the displaced liquid to pass through a perforated metal sheet located on the rotary drum. A further development of the original drum washer is the pressurized displacement washer, where the filtrate at overpressure, is caused to pass through the metal sheet. The increase in the pressure difference brings about an improved dewatering of the pulp. The increased pressure difference in the pressurized displacement washer can have the effect that the pulp web deposits itself harder on the metal sheet of the drum, and at times therefore has to be removed by some kind of auxiliary means. The pulp web, for example, can then be loosened by means of liquid or air.

According to a known design of a pressurized displacement washer, the drum is provided with compartments, in which the pulp places itself as oval rectangles in the axial direction of the drum on the metal sheet. Compartmentalization of the drum ensures that the pulp cake does not break up and move, but instead maintains the form produced during application of the pulp. The compartments consist of bars arranged axially along the entire drum, which bars constitute the walls of these compartments. The perforated metal sheet, on which the pulp deposits, is located at a distance from the axle of the drum, so that filtrate channels are formed in the space between the drum and the metal sheet. Along the circumference of the drum there are, thus, at least as many filtrate compartments as pulp compartments. In a drum washer a plurality of different washing stages can be carried out, with separate addition of washing liquid to the different stages, and also with recycling of filtrate from one stage as washing liquid to another stage.

In order to maintain maximum washing effectiveness, it is desired to ensure that washing liquid intended for a specific washing stage is not moved to a later washing stage. Washing liquid intended for a washing stage later in the process is cleaner than the washing liquid used in a preceding washing stage. Due to a pressure difference between the stages the supplied washing liquid tends to move to the lower pressure. In order to be able to separate different washing stages and forming stages, as well as discharge stages, the respective stages are sealed by axial seals, which are placed between the compartment walls of the rotary drum and a pressure-bearing casing extending all about the drum. The filtrates from the respective stages are separated by seals in a peripheral end valve located at one or both end walls of the drum.

In a washing arrangement according to the prior art, the axial seals are positioned in a direction to the center of the drum by means of a number of cylinders, usually 2 or 3 cylinders, which are placed along the length of the seal. The cylinders are controlled in parallel with each other, so that the seal occupies the same position in the radial direction in the entire longitudinal extension of the seal. If the seal becomes worn to a greater extent on one portion, as seen in its longitudinal extension, it would not be possible to remedy this, because the seal switches off by means of spring washers or the like during undesired contact between the compartment walls of the drum and the seal. It is thus sufficient that one portion of the seal is in contact with the compartment wall of the drum for the seal to switch off. If the seal becomes worn unevenly, there is an increased risk of leakage, because the portion most worn will not seal as desired.

One of the objects of the present invention is to solve the aforesaid problems.

SUMMARY OF THE INVENTION

In accordance with the present invention, this and other objects have now been realized by the invention of a washer for washing and dewatering cellulosic pulp material comprising a rotary drum, a plurality of axial compartment walls disposed on the rotary drum defining a plurality of axial compartments therebetween, a stationary cylindrical casing enclosing the rotary drum thereby defining a ring-shaped space between the stationary cylindrical casing and the rotary drum, and a plurality of axially extending seals dividing the ring-shaped space into a forming zone for forming the cellulosic pulp material, at least one washing zone for washing the cellulosic pulp material under an overpressure, and a discharge zone for discharging the washed cellulosic pulp material, a plurality of positioning cylinders corresponding to the plurality of axially extending seals for adjusting the radial position of the plurality of axially extending seals, the plurality of positioning cylinders attached to the corresponding plurality of axially extending seals for articulation therebetween for oblique positioning of the corresponding plurality of axially extending seals with respect to the rotary drum. Preferably the plurality of positioning cylinders are articulated with respect to the corresponding plurality of axially extending seals for oblique positioning in the radial direction with respect to the center of the rotary drum.

In accordance with one embodiment of the washer of the present invention, the plurality of positioning cylinders comprises at least two of the positioning cylinders corresponding to each of the corresponding plurality of axially extending seals. In a preferred embodiment, the at least one of the at least two positioning cylinders is articulated with respect to the corresponding plurality of axially extending seals for positioning in the axial direction with respect to the rotary drum. Preferably, the articulation between the at least one of the at least two positioning cylinders comprises a link, including an aperture in the axial direction of the link, and a pin received within the aperture in the link, the aperture having an extension greater than the length of the pin. In a preferred embodiment, the aperture has an oval cross-section, and the pin has a diameter substantially corresponding to the smallest dimension of the oval cross-section of the aperture.

In accordance with one embodiment of the washer of the present invention, the washer includes electronic control means for controlling the plurality of positioning cylinders.

In accordance with another embodiment of the washer of the present invention, the washer includes hydraulic control means for controlling the plurality of positioning cylinders.

In accordance with the present invention, by designing the washing arrangement in such a way that the positioning cylinders are articulately connected with the seal, the longitudinal seal can be positioned obliquely.

A first parallel adjustment can be made, as before, with the cylinders, but the individual final position, in the radial direction, can be set by means of oblique positioning by means of the link.

In this way it is ensured that the distance between the seal and the compartment walls of the drum is the same along the entire longitudinal extension of the seal.

The articulated connection consists of a link in the seal. The link is located in a recess in the positioning cylinder and is provided with a hole for receiving a pin to connect the link to the cylinder.

According to one embodiment of the present invention, at least one of the positioning cylinders can be located so that axial movement of the seal can take place. This axial movement can be made possible, for example, by means of the fact that the hole for receiving the pin is made greater in the axial direction than the extension of the pin in that same direction. The hole can, for example, be oval and the pin can have a circular cross-section. The axial movement is particularly important in those cases where the oblique position implies great differences in the radial position of the seal in the areas corresponding to the different positioning cylinders. The seal could otherwise be exposed to stresses, which in the worst case can result in fracture. The possibility of axial movement is also an advantage when the seal is elongated, for example by heat expansion.

The positioning cylinders can be controlled by electric motors or hydraulically. The control is carried out so that a certain predetermined contact force is not exceeded.

During undesired contact between the seal and compartment walls of the drum, or some other part of the drum, the control is set to rapidly remove the seal in a direction radially outward. During positioning there is a transmitter for each cylinder, so that the correct contact force can be determined and, thus, the position can be adjusted for the different portions of a longitudinal seal. The transmitter, for example, can sense load or moment for a correct control of the position.

BRIEF DESCRIPTION OF THE DRAWINGS

The present invention is described in greater detail in the following detailed description, which in turn refers to the Figures, in which.

DETAILED DESCRIPTION

Figure 1:
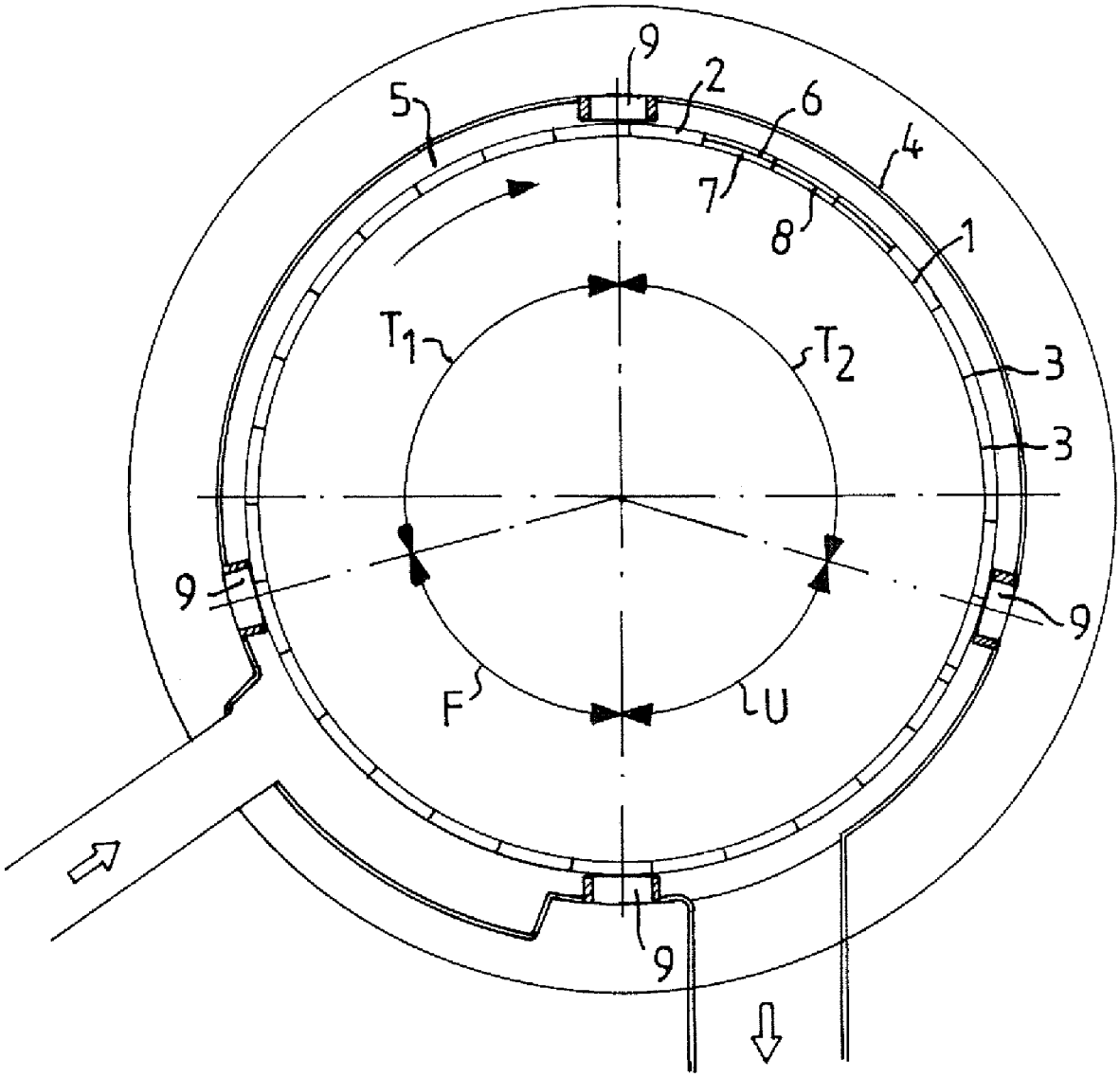
FIG. 1 is a side, elevational, partially schematic view of a compartmented drum washer with two washing stages, seen from the end wall of the drum.

Referring to the figures, FIG. 1 shows a compartmented drum washer with two washing stages. The washing arrangement comprises a rotary drum (1) with a plurality of external compartments (2) on the drum for the pulp to be washed, which compartments are defined by axial compartment walls (3) distributed along the circumference of the drum, a stationary cylindrical casing (4) enclosing the drum, whereby a ring-shaped space (5) is defined between the casing and the drum, and where the ring-shaped space, by means of longitudinal seals (9) in the axial direction of the drum, is divided into a forming zone (F) for forming the pulp in the compartments of the drum, at least one washing zone (T1, T2) for washing the pulp under an overpressure, and a discharge zone (U) for discharging the washed pulp, and where the external compartments are divided (only shown in parts of the Figure) into a pulp compartment (6) and a filtrate compartment (7) separated by a perforated metal sheet (8), where the filtrates from the filtrate compartments associated with the respective zones are taken out in the axial direction, and separated by seals in an overall valve at at least one of the end walls of the drum.

Figure 2:
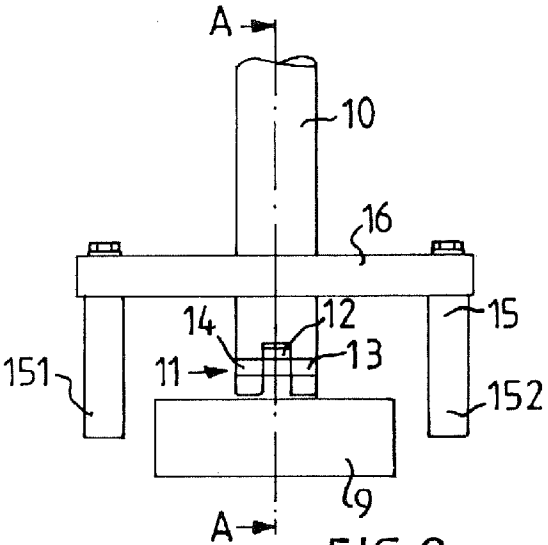
FIG. 2 is a front, elevational view of a seal arrangement according to the present invention.

In FIG. 2 there is shown an axial longitudinal seal according to the present invention. A seal 9 is connected to a positioning cylinder 10 by means of a cylinder attachment 11, which consists of a link 12 connected to the cylinder by a pin 13 in a hole. The seal is adjustably located in a frame structure 15 consisting of frame walls (151 and 152). The frame structure is located in an opening in the overall casing (not shown) of the washing arrangement. A detachable cover 16 to the frame structure is placed at the portion of the frame structure which extends outwardly from the overall casing. The positioning cylinder 10 extends through the cover 16.

Figure 3:
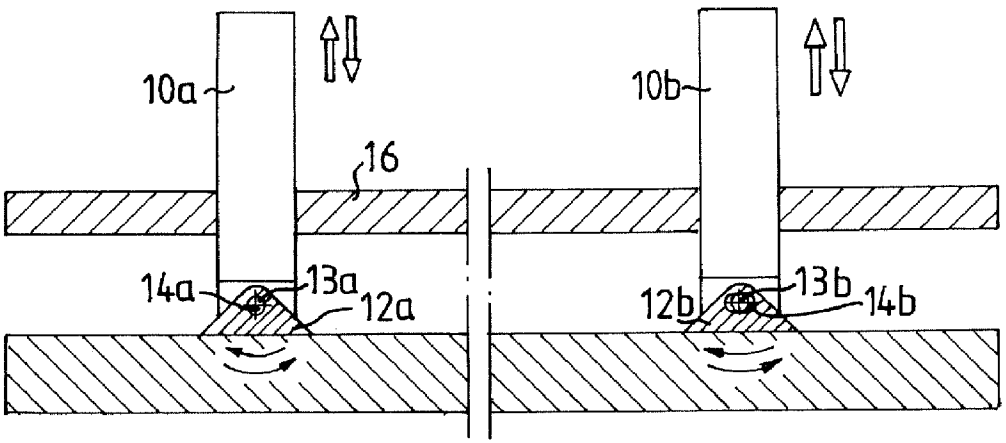
FIG. 3 is a side, elevational view of a seal arrangement according to the present invention, as seen in section A-A in FIG. 2.

FIG. 3 is a cross-section of a washing arrangement according to section A-A in FIG. 2. The seal has an articulated connection with two positioning cylinders 10 by means of the cylinder attachment 11. The cylinder attachment consists of links 12 mounted in the cylinders by means of pins 13 in holes 14 in the cylinders. The arrows below the respective cylinder attachment illustrate the directions of oblique positions possible for the seal. The positioning cylinders, 10*a* and 10*b*, can move in the height direction according to the arrows at the cylinders 10 in order to position the seal at a correct distance from the drum. By means of the link 12 the seal can then be positioned obliquely so that a portion of the seal which has been worn to a greater extent nevertheless remains at the same distance from the compartment walls as the other half. Each cylinder 10 has an articulated connection to the seal, so that the final position of the seal in the radial position in the area about a cylinder can be controlled independently of the positioning at the other cylinders.

Figure 4:
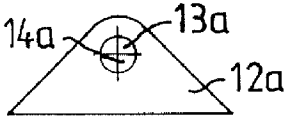
FIG. 4 is a side, elevational, enlarged view of the link 12*a* in FIG. 3.

FIG. 4 shows a first link 12*a* intended to connect a first positioning cylinder 10*a* with the seal. A pin 13*a* located in a hole 14*a* connects the cylinder and the link. The hole 14*a* has an essentially circular cross-section, the diameter of which approximately corresponds to the diameter of the pin.

Figure 5:
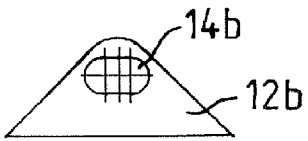
FIG. 5 is a side, elevational, enlarged view of the link 12*b* shown in FIG. 3.

FIG. 5 shows a second link 12*b* intended to connect a second positioning cylinder 10*b* with the seal. A pin 13*b* located in a hole 14*b* connects the cylinder and the link. The hole 14*b* has an oval cross-section, the longest extension of which extends in the axial direction. The pin 13*b* has a circular cross-section. The shape of the hole makes it possible for the pin to move in axial direction.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A washer for washing and dewatering cellulosic pulp material comprising a rotary drum, a plurality of axial compartment walls disposed on said rotary drum defining a plurality of axial compartments therebetween, a stationary cylindrical casing enclosing said rotary drum thereby defining a ring-shaped space between said stationary cylindrical casing and said rotary drum, and a plurality of axially extending seals dividing said ring-shaped space into a forming zone for forming said cellulosic pulp material, at least one washing zone for washing said cellulosic pulp material under an overpressure, and a discharge zone for discharging said washed cellulosic pulp material, a plurality of positioning cylinders corresponding to said plurality of axially extending seals for adjusting the radial position of said plurality of axially extending seals, said plurality of positioning cylinders attached to said corresponding plurality of axially extending seals for articulation therebetween for oblique positioning of said corresponding plurality of axially extending seals with respect to said rotary drum.

2. The washer of claim 1 wherein said plurality of positioning cylinders are articulated with respect to said corresponding plurality of axially extending seals for oblique positioning in the radial direction with respect to the center of said rotary drum.

3. The washer of claim 1 wherein said plurality of positioning cylinders comprises at least two of said positioning cylinders corresponding to each of said corresponding plurality of axially extending seals.

4. The washer of claim 3 wherein at least one of said at least two positioning cylinders is articulated with respect to said corresponding plurality of axially extending seals for positioning in the axial direction with respect to said rotary drum.

5. The washer of claim 4 wherein said articulation between said at least one of said at least two positioning cylinders comprises a link, including an aperture in the axial direction of said link, and a pin received within said aperture in said link, said aperture having an extension greater than the length of said pin.

6. The washer of claim 5 wherein said aperture has an oval cross-section, and said pin has a diameter substantially corresponding to said smallest dimension of said oval cross-section of said aperture.

7. The washer of claim 1 including electronic control means for controlling said plurality of positioning cylinders.

8. The washer of claim 1 including hydraulic control means for controlling said plurality of positioning cylinders.

* * * * *